US009253841B2

(12) United States Patent
Yang

(10) Patent No.: US 9,253,841 B2
(45) Date of Patent: Feb. 2, 2016

(54) LED BACKLIGHT DRIVING CIRCUIT AND METHOD FOR DRIVING THE LED BACKLIGHT DRIVING CIRCUIT

(71) Applicant: SHENZHEN CHINA STAR OPTOELECTRONICS TECHNOLOGY CO., LTD, Shenzhen (CN)

(72) Inventor: Xiang Yang, Shenzhen (CN)

( * ) Notice: Subject to any disclaimer, the term of this patent is extended or adjusted under 35 U.S.C. 154(b) by 160 days.

(21) Appl. No.: 14/235,091

(22) PCT Filed: Jan. 6, 2014

(86) PCT No.: PCT/CN2014/070180

§ 371 (c)(1),
(2) Date: Jan. 27, 2014

(87) PCT Pub. No.: WO2015/096200

PCT Pub. Date: Jul. 2, 2015

(65) Prior Publication Data

US 2015/0305105 A1 Oct. 22, 2015

(30) Foreign Application Priority Data

Dec. 27, 2013 (CN) ..... 2013 1 0737842

(51) Int. Cl.
*H05B 37/02* (2006.01)
*H05B 33/08* (2006.01)
*G09G 3/34* (2006.01)

(52) U.S. Cl.
CPC ..... *H05B 33/0845* (2013.01); *G09G 3/3406* (2013.01); *H05B 33/0806* (2013.01); *H05B 37/02* (2013.01); *G09G 2320/062* (2013.01); *G09G 2330/021* (2013.01)

(58) Field of Classification Search
CPC ... H05B 41/24; H05B 33/0815; H05B 39/041
USPC ..... 315/291, 294, 297, 307
See application file for complete search history.

(56) References Cited

U.S. PATENT DOCUMENTS 8,610,371 B2 * 12/2013 Lee ..... 315/291
8,941,327 B2 * 1/2015 Ryu ..... H05B 33/0827 315/185 R
2009/0302776 A1 * 12/2009 Szczeszynski ..... H05B 33/0815 315/246
2010/0026203 A1 * 2/2010 Zhao ..... H05B 33/0815 315/291
2011/0115770 A1 * 5/2011 Seo ..... G09G 3/32 345/211
2012/0056864 A1 3/2012 Aioanei
2014/0168567 A1 * 6/2014 Kikuchi ..... H05B 33/0815 349/61

(Continued)

FOREIGN PATENT DOCUMENTS

CN 101436386 A 5/2009
CN 101677482 A 3/2010

(Continued)

OTHER PUBLICATIONS

Li Wenfei, the International Searching Authority written comments, Sep. 2014, CN.

*Primary Examiner* — Jason M Crawford

(57) ABSTRACT

A light emitting diode (LED) backlight driving circuit includes a power assembly, a control assembly, and at least two LED lamps. The control assembly generates a power control signal according to a working state of the LED lamp, and the power assembly outputs a power corresponding to an on-LED lamp according to the power control signal.

6 Claims, 4 Drawing Sheets

(56) References Cited

U.S. PATENT DOCUMENTS

2014/0211192 A1* 7/2014 Grootjans ..... H05B 33/0818
356/5.01
2014/0339991 A1* 11/2014 Zhang ..... G09G 3/36
315/186

FOREIGN PATENT DOCUMENTS

CN 102265706 A 11/2011
CN 202855274 U 4/2013
CN 103280193 A 9/2013

* cited by examiner

LED BACKLIGHT DRIVING CIRCUIT AND METHOD FOR DRIVING THE LED BACKLIGHT DRIVING CIRCUIT

TECHNICAL FIELD

The present disclosure relates to t a display screen, and more particularly to a driving circuit of a backlight unit of the display screen and a method for driving the backlight unit of the display screen.

BACKGROUND

A typical method for driving a backlight of a display screen not only includes turning on a light emitting diode (LED) lamp but also includes other ways, such as local dimming, three-dimensional (3D) scanning, and the like. A microcontroller (MCU) is usually arranged in the display screen to process data. However, the MCU only drives the LED lamp and makes a plurality of LED lamps simultaneously turn on/off and control a power chip to work according to a constant frequency. Thus, an output power of a direct current (DC)-DC voltage converter is not in relation with multi-channels dimming frequency, and the power chip is not affected in real time. In low brightness conditions, the power chip works in the constant frequency, a power loss of the backlight driving circuit is same as a power loss in high brightness conditions.

SUMMARY

The aim of the present disclosure is to provide a backlight driving circuit and a method for driving the backlight driving circuit capable of reducing a power loss of driving backlight.

The aim of the present disclosure is achieved by the following methods.

A light emitting diode (LED) backlight driving circuit comprises a power assembly, a control assembly, and at least two LED lamps. The control assembly generates a power control signal according to a working state of the LED lamp, and the power assembly outputs a power corresponding to an on-LED lamp according to the power control signal.

Furthermore, the power assembly comprises a boost unit and a power chip, the power chip controls an output power of the boost unit. The control assembly comprises an oscillating circuit and a control unit, the control unit generates a resistance control signal according to the working state of the LED lamp, the oscillating circuit generates the power control signal according to the resistance control signal and sends the power control signal to the power chip. The power chip controls the boost unit to output the power corresponding to an on-LED lamp according to the power control signal. The control assembly transforms the working state of the LED lamp into an electrical signal, and feedbacks the electrical signal to the power chip. The power chip adjusts the work frequency thereof according to the electrical signal feedback by the control assembly. When the brightness of one half LED lamps reduces, only one half full power of the power chip is need for the on-LED lamps, therefore, the power loss is effectively reduced.

Furthermore, the oscillating circuit comprises a variable resistance unit, the variable resistance unit comprises a resistor and a controllable switch parallel from the resistor. The power chip comprises a frequency control pin. The variable resistance unit adjusts a resistance according to the resistance control signal through the controllable switch. The oscillating circuit generates the power control signal according to a changed resistance of the variable resistance unit and sends the power control signal to the frequency control pin, and the power chip controls the boost unit to output the power corresponding to the on-LED lamp according to the power control signal. The variable resistance unit adjusts the resistance thereof according to the resistance control signal, and generates the power control signal according to the changed resistance, the power control signal controls the power chip, which allows the working state of the LED lamp to be actually feedback to the power chip. The power chip outputs the power corresponding to a working state of the LED lamp according to the feedback control, thereby effectively reduces the power loss.

Furthermore, the control unit further comprises an integral circuit and a control chip, the controllable switch is a semiconductor controllable switch. The control chip transforms the working state of the LED lamp into an analog signal, and the integral circuit processes the analog signal to generate a resistance control signal. The resistance control signal is sent to a control end of the semiconductor controllable switch. The analog signal is processed by the integral circuit to transform into the electrical signal that effectively controls the semiconductor controllable switch of the variable resistance unit, and the working state of the LED lamp is really feedback to the power chip through controlling and adjusting the resistance of the variable resistance unit. Therefore, the power chip adjusts the output power thereof according to the working state of the LED lamp, which effectively reduces the power loss.

Furthermore, the control unit further comprises a memory chip storing the working timing of the LED lamps. The control chip obtains the working state of the LED lamps from the memory chip, and transforms the working timing of the LED lamps into the analog signal. The integral circuit generates the resistance control signal according to the analog signal, and the resistance control signal is used for controlling the semiconductor controllable switch. Some of the working timing of the LED lamp is constant. When a backlight is driven through a three-dimensional (3D) scanning, the working timing of the LED lamp is more stable than the working timing of the LED lamp in other driving models, thus, the working timing of the LED lamp is prestored in the memory chip, and is directly read from the memory chip when needed, which reduces the power loss of the control assembly, and improves response speed of the LED lamp.

Furthermore, the control unit further comprises a timing control chip transforming the working state of the LED lamp into the display driving timing. The control chip obtains the working state of the LED lamps from the timing control chip, and transforms the working state of the LED lamps into the analog signal. The integral circuit generates the resistance control signal according to the analog signal, and the resistance control signal controls the semiconductor controllable switch. Some of the working timing of the LED lamp is changed. When the backlight is driven through a local dimming, the working timing of the LED lamp is adjusted according to the video signal, the TCON transforms the working timing adjusted of the LED lamp into the display driving timing, and the SOC transforms the video signal into the display driving timing, which makes the backlight driving circuit adjust the output power of the power assembly according to the working state of the LED lamp, and thereby avoiding the power loss.

Furthermore, the power assembly comprises the power chip and the boost unit, and the control assembly comprises the oscillating circuit and the control unit. The oscillating circuit comprises a variable resistance unit, and the control unit comprises a control chip and a timing control chip. The power assembly comprises a frequency control pin and a frequency output pin, the frequency control pill comprises a first reference voltage pin and an oscillation pin. The variable resistance unit comprises a bipolar junction transistor, a resistor, and a capacitor. The bipolar junction transistor and the resistor are connected with each other in parallel to form a parallel circuit, a first end of the parallel circuit is coupled to the first reference voltage pin, a first end of the capacitor and the oscillation pin are coupled to a second end of the parallel circuit, and a second end of the capacitor is connected to a ground end of the backlight driving circuit. The control unit comprises an integral circuit, a timing control chip, and a control chip. The integral circuit comprises an operational amplifier, a load resistor connected to the operational amplifier in parallel, and a load capacitor, a first end of the load capacitor is connected to an input end of the operational amplifier, and a second end of the load capacitor is coupled to an output end of the load capacitor through the load resistor. A control end of the bipolar junction transistor of the variable resistance unit is coupled to the output end of the operational amplifier. The control chip comprises a digital to analog converter and a memory chip that stores the working timing of the LED lamps, an output end of the digital to analog converter is coupled to the input end of the operational amplifier. The timing control chip generates a display driving timing according to the working state of the LED lamp, and the digital to analog converter transforms the working timing of the LED lamps or the display driving timing into an analog signal to output to the integral circuit. The analog signal is processed into the resistance control signal by the integral circuit, and a variable resistance area of the bipolar junction transistor of the variable resistance unit adjusts a resistance according to the resistance control signal. The oscillating circuit generates the power control signal according to a changed resistance of the variable resistance unit, and feedbacks the power control signal to the power chip, the power chip controls the boost unit to output the power corresponding to the on-LED lamp according to the power control signal through the frequency output pin. The present disclosure provides an exemplary feedback system, which effectively transforms the working state of the LED lamp into the power control signal that controls the output power of the power chip. Thus, when the brightness of a part of LED lamps reduces, the boost unit decreases a working frequency thereof and the power loss, when most LED lamps or all LED lamps are turn on, the power chip increases the working frequency thereof in time according to the power control signal, thereby avoids the loss of the brightness of the LED lamp due to low power. A clock frequency of the control chip (MCU) is equal to or greater than a million hertz (MHz). For example, if the clock frequency of the control chip MCU is 32 MHz, a period of each of instructions is about 30 nanoseconds (ns), a time of an interrupt response is about four periods of the instruction, and a time of transforming the display driving timing into the analog signal is about two periods of the instruction, thus, a total delay time is about six periods of the instruction, namely the delay time is 180 ns (0.18 us). The time of 0.18 us can be ignored relative to a dimming time, thus, a question of the power does not satisfying the requirement of the LED lamp for reducing the brightness of the LED lamp is not exist due to a delay feedback. Additionally, the bipolar junction transistor with characteristics of the variable resistor changes the resistance thereof according to the working state of the LED lamp. The integral circuit processes the signal from the digital to analog converter to limit the range of the output voltage thereof, and makes the output voltage thereof be in the range of response voltage of the variable resistance area of the bipolar junction transistor, which avoids the bipolar junction transistor from entering a state of a breakdown region because of an excessive or too low of a voltage. Thus, the variable resistance unit and the capacitor output the power control signal corresponding to the working state of the LED lamp according to the working state of the LED lamp, where the power control signal controls the output power of the power assembly.

A method for driving a light emitting diode (LED) backlight driving circuit comprises following steps:

reading a working state of an LED lamp by a control assembly, outputting a power control signal corresponding to the working state of the LED lamp by the control assembly, and outputting a power corresponding to an on-LED lamp according to the power control signal by a power assembly.

The power control signal controlling the output power of the power assembly is obtained according to the working state of the LED lamp, which improves relativity between the LED lamp and the power assembly. Thus, the power assembly adjusts the output frequency thereof according to the working state of the LED lamp, thereby reducing unexpected power.

Furthermore, the method for driving the LED backlight driving circuit comprises following steps:

prestoring a working timing of each of the LED lamps through the control assembly;

transforming the working timing of the LED lamp into an analog signal by a digital to analog converter, controlling a variable resistance unit to adjust a resistance by an integral circuit, and generating the power control signal corresponding to the working state of the LED lamp according to the resistance of the variable resistance unit by an oscillating circuit; and controlling a boost unit to output the power corresponding to the on-LED lamp according to the power control signal by the power chip of the power assembly.

The working timing of the LED lamps is prestored, and is read when needed, which improves response speed of the backlight driving circuit. The working state of the LED lamp is transformed into a change of the resistance of the variable resistance unit that can be received by the power assembly, which feedbacks the working state of the LED lamp to the power assembly. Thus, the power assembly adjusts the output power thereof according to the working state of the LED lamp, thereby improves a work efficiency of the backlight driving.

Furthermore, the method for driving the LED backlight driving circuit comprises:

reading the working state of the LED lamp from the timing control by the control assembly;

transforming the working state of the LED lamp into an analog signal by a digital to analog converter, controlling a variable resistance unit to adjust a resistance by an integral circuit, and generating the power control signal corresponding to the working state of the LED lamp according to the resistance of the variable resistance unit by an oscillating circuit; and controlling a boost unit to output the power corresponding to the on-LED lamp according to the power control signal by the power chip of the power assembly.

The timing control chip dynamically reads the working state of the LED lamp, transforms and sends a real-time working state of the LED lamp to the power chip, which makes the power chip output the power corresponding to the on-LED lamp. Thus, when the brightness of most or all LED lamps decreases, the power assembly reduces the output power and the power loss, and when the brightness of most or all LED lamps increases, the power assembly increases the output power, which avoids the lack of the brightness of the LED lamp because of the low power.

It should be understood that a plurality of LED lamps can be simultaneously turn on/off when driving a backlight of a typical display screen, and the power chip works according to a constant frequency. Thus, an output power of the power chip is not in relation with multi-channels dimming frequency and the power chip is not affected in real time. In low brightness conditions, the power chip works in the constant frequency, a power loss of the backlight driving circuit is same as a power loss in high brightness conditions. The control assembly reads the working state of the LED lamp, and generates the power control signal that controls the power assembly, which makes the power assembly output the power corresponding to the working state of the on-LED lamp. Thus, when the brightness of the on-LED lamp reduces, the power assembly outputs the power corresponding to the on-LED lamp having low brightness, and does not output the power corresponding to an original LED lamp having great brightness, which reduces the power loss. When the brightness of the on-LED lamp increases, especially a plurality of LED lightbars is on, the power assembly increases the output power to satisfy requirement of the on-LED lamp, thereby avoids loss of the brightness of the LED lamp due to a low power.

DETAILED DESCRIPTION

Figure 1:
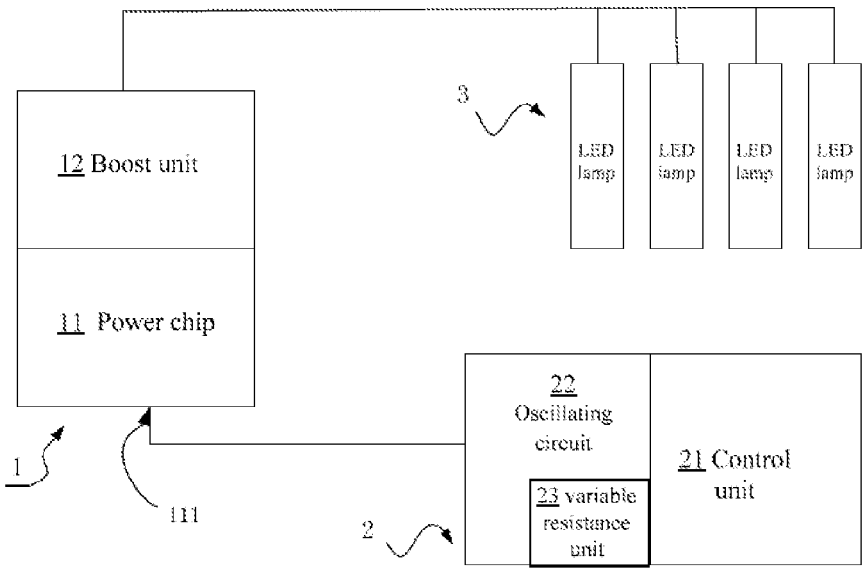
FIG. 1 is a block diagram of a backlight driving circuit of the present disclosure.

FIG. 1 is a block diagram of a backlight driving circuit of the present disclosure, the backlight driving circuit comprises a power assembly 1, a control assembly 2, and at least two light emitting diode (LED) lamps 3. The control assembly 2 generates a power control signal according to a working state of the LED lamp 3, and the power assembly 1 outputs a power corresponding to an on-LED lamp under a control of the power control signal.

The power assembly 1 comprises a boost unit 12 and a power chip 11, the power chip 11 controls an output power of the boost unit 12 through a frequency and the power chip 11 comprises a frequency control pin 111. The control assembly 2 comprises an oscillating circuit 22 and a control unit 21, and the oscillating circuit comprises a variable resistance unit 23. The control unit 2 generates a resistance control signal according to the working state of the LED lamp 3, the oscillating circuit 22 is coupled to the frequency control pin 111, and the variable resistance unit 23 adjusts a resistance thereof according to the resistance control signal. The oscillating circuit 22 generates the power control signal according to a changed resistance of the variable resistance unit 23, and sends the power control signal to the frequency control pin 111. The power chip 11 controls the boost unit 12 to output the power corresponding to the on-LED lamp 3 according to the power control signal.

It should be understood that a plurality of LED lamps 3 can be simultaneously turn on/off when driving a backlight of a typical display screen, and the power chip works according to a constant frequency, thus, an output power of the power chip is not in relation with the working state of the plurality of LED lamps, and the power chip is not affected in real time. In low brightness conditions, the power chip 11 works in the constant frequency, a power loss of the backlight driving circuit is same as a power loss in high brightness conditions. The present disclosure uses the control assembly, the control assembly reads the working state of the LED lamp, and generates the power control signal controlling the power assembly to output the power corresponding to the on-LED lamp. Thus, when brightness of the on-LED lamp reduces, the power assembly outputs the power corresponding to the on-LED lamp having low brightness, and does not output the power corresponding to an original LED lamp having great brightness, which reduces a power loss. When the brightness of the on-LED lamp increases, the power assembly increases the output power to satisfy requirement of the on-LED lamp, and thereby avoids loss of the brightness of the LED lamp due to a low power.

The present disclosure will further be described in detail in accordance with the figures and the exemplary examples.

Figure 2:
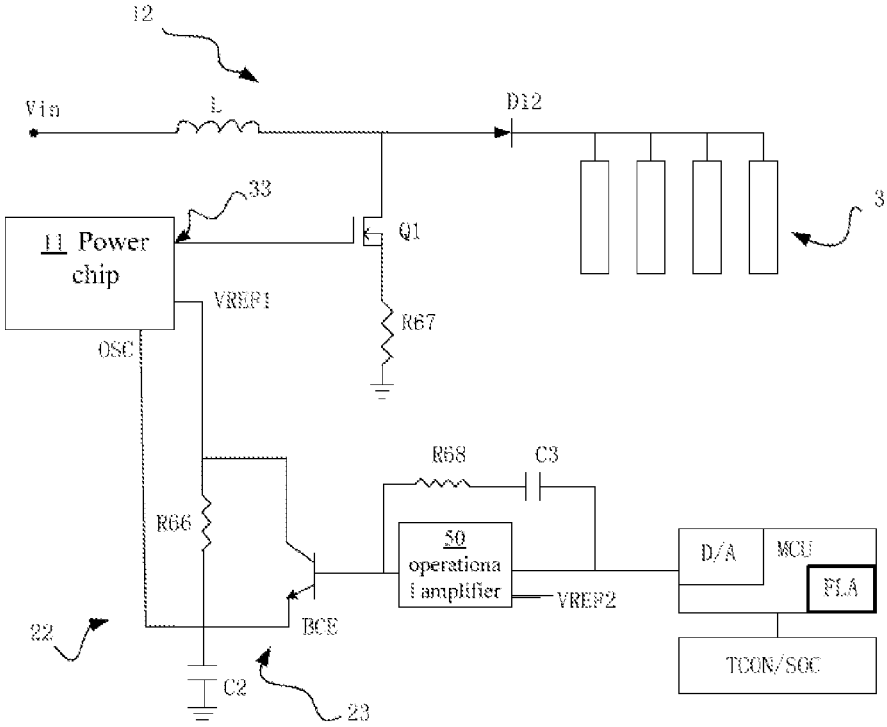
FIG. 2 is a circuit diagram of a backlight driving circuit of the present disclosure.

FIG. 2 is a circuit diagram of a backlight driving circuit of the present disclosure, the backlight driving circuit comprises the power assembly, the control assembly, and at least two LED lamps. The power assembly comprises the power chip 11 and the boost unit 12, and the control assembly comprises the oscillating circuit and the control unit. The power assembly comprises the frequency control pin and a frequency output pin 33, the frequency control pin 33 comprises a first reference voltage pin VREF1 and an oscillation pin OSC. The oscillating circuit 22 comprises the variable resistance unit 21, and the variable resistance unit comprises a controllable switch and a resistor R66 connected with each other in parallel, where the controllable switch is a semiconductor controllable switch, namely the controllable switch is a bipolar junction transistor BCE. The oscillating circuit 22 further comprises a capacitor C2, a first end of the capacitor C2 and the oscillation pin OSC are coupled to a second end of a parallel circuit that is formed by the bipolar junction transistor BCE and the resistor R66, a first end of the parallel circuit is coupled to the first reference voltage pin VREF1, and a second end of the capacitor C2 is connected to a ground end of the backlight driving circuit. The control unit comprises an integral circuit, a timing control chip TCON, and a control chip MCU. The integral circuit comprises an operational amplifier 50, a second reference voltage VREF2, a load resistor R68 connected to the operational amplifier 50 in parallel, and a load capacitor C3, where a first end of the load capacitor C3 is connected to an input end of the operational amplifier 50, and a second end of the load capacitor C3 is coupled to an output end of the load capacitor C3 through the load resistor R68. A control end of the bipolar junction transistor BCE of the variable resistance unit is coupled to the output end of the operational amplifier 50. The control chip MCU comprises a digital to analog converter D/A and a memory chip FLA that stores a working timing of the LED lamps, where an output end of the digital to analog converter D/A is coupled to the input end of the operational amplifier 50. The timing control chip TCON generates a display driving timing according to the working state of the LED lamp, and the digital to analog converter transforms the working timing of the LED lamps or the display driving timing into an analog signal to output to the integral circuit. The analog signal is processed into the resistance control signal, and a variable resistance area of the bipolar junction transistor of the variable resistance unit adjusts a resistance thereof according to the resistance control signal. The oscillating circuit generates the power control signal according to the changed resistance of the variable resistance unit, and feedbacks the power control signal to the power chip, the power chip controls the boost unit to output the power corresponding to the on-LED lamp according to the power control signal and through the frequency output pin.

The working state of the LED lamp can be read from a system-on-chip (SOC) generating a video signal determining the working state of the LED lamp. Some of working timing of the LED lamp is constant. When a backlight is driven through a three-dimensional (3D) scanning, the working timing of the LED lamp is more stable than the working timing of the LED lamp in other driving models, thus, the working timing of the LED lamp can be prestored in the memory chip, and can be directly read from the memory chip when needed, which reduces workload of the control assembly, and improves response speed of the LED lamp. Some of the working timing of the LED lamp is changed. When the backlight is driven through a local dimming, the working timing of the LED lamp is adjusted according to the video signal, the ICON transforms the working timing of the LED lamp adjusted into the display driving timing, and the SOC transforms the video signal into the display driving timing, which makes the backlight driving circuit adjust the output power of the power assembly according to the working state of the LED lamp, thereby avoiding the power loss.

The above-mentioned semiconductor controllable switch is the bipolar junction transistor, and mainly uses a characteristic of the variable resistance area of the bipolar junction transistor to change the resistance thereof according to the resistance control signal sent by the control unit, thus, the resistance of the variable resistance unit is changed, which makes the oscillating circuit output a determined oscillating waveform, namely the power control signal controls an output of the power chip. It should be understood that the power assembly can also adjust the power to correspond to the on-LED lamp according to the working state of the LED lamp when the bipolar junction transistor is only regarded as a switch. The semiconductor controllable switch may be other semiconductors having a same similar function with the bipolar junction transistor, such as a field-effect transistor, and the like.

The backlight driving circuit further comprises an input voltage Vin. The boost unit comprises a switch Q1, an energy storage inductor L, a diode D12 for rectification, and a divider resistor R67, and the boost unit further comprises a filter capacitor (not shown in FIG. 2).

The control assembly transforms the working state of the LED lamp into an electrical signal, and feedbacks the electrical signal to the power chip. The power chip adjusts the work frequency thereof according to the electrical signal feedback by the control assembly. When the brightness of one half LED lamps reduces, only one half full power of the power chip is need for the on-LED lamps, thus, the power loss is effectively reduced.

The timing control chip TCON generates the display driving timing according to the working state of the LED lamp, the display driving timing is transformed into the analog signal through the digital to analog converter, and is sent to the integral circuit. The integral circuit processes the analog signal into the resistance control signal that controls the resistance of the bipolar junction transistor of the variable resistance unit, the changed resistance of the bipolar junction transistor makes a resistance of the parallel circuit comprising the bipolar junction transistor be changed. The changed resistance of the parallel circuit comprising the bipolar junction transistor is feedback to the power chip in time, the power chip adjusts the output frequency of the frequency output pin according to the changed resistance of the parallel circuit comprising the bipolar junction transistor, and controls the boost unit to output the power corresponding to the on-LED lamp. The present disclosure provides an exemplary feedback system, which effectively transforms the working state of the LED lamp into the power control signal that controls the output frequency of the power chip. Thus, when the brightness of some of the LED lamps reduces, the power chip decreases a working frequency thereof and the power loss, when most LED lamps or all LED lamps are on, the power chip can increase the working frequency thereof in time according to the power control signal, thereby avoiding the lack of the brightness of the LED lamp due to a low power. A clock frequency of the control chip MCU is in or exceeds a grade of a million hertz (MHz). If the clock frequency of the control chip MCU is 32 MHz, a period of each of instructions is about 30 ns, a time of an interrupt response is about four periods of the instruction, and a time of transforming, the display driving timing into the analog signal is about two periods of the instruction, thus, a total delay time is about six periods of the instruction, namely the delay time is 180 ns (0.18 us). The time of 0.18 us can be ignored relative to a dimming time, thus, a question of the power does not satisfying the requirement of the LED lamp to make the brightness of the LED lamp reduce is not exist due to a delay feedback. Additionally, the bipolar junction transistor uses the characteristics of the variable resistor to change the resistance thereof according to the working state of the LED lamp. The integral circuit processes the signal from the digital to analog converter to limit the range of the output voltage thereof, and makes the output voltage thereof be in the range of response voltage of the variable resistance area of the bipolar junction transistor, which avoids the bipolar junction transistor from a state of a breakdown region because of an excessive or underestimate voltage. Thus, the variable resistance unit and the capacitor output the power control signal corresponding to the working state of the LED lamp according to the working state of the LED lamp, where the power control signal controls the output power of the power assembly.

Figure 3:
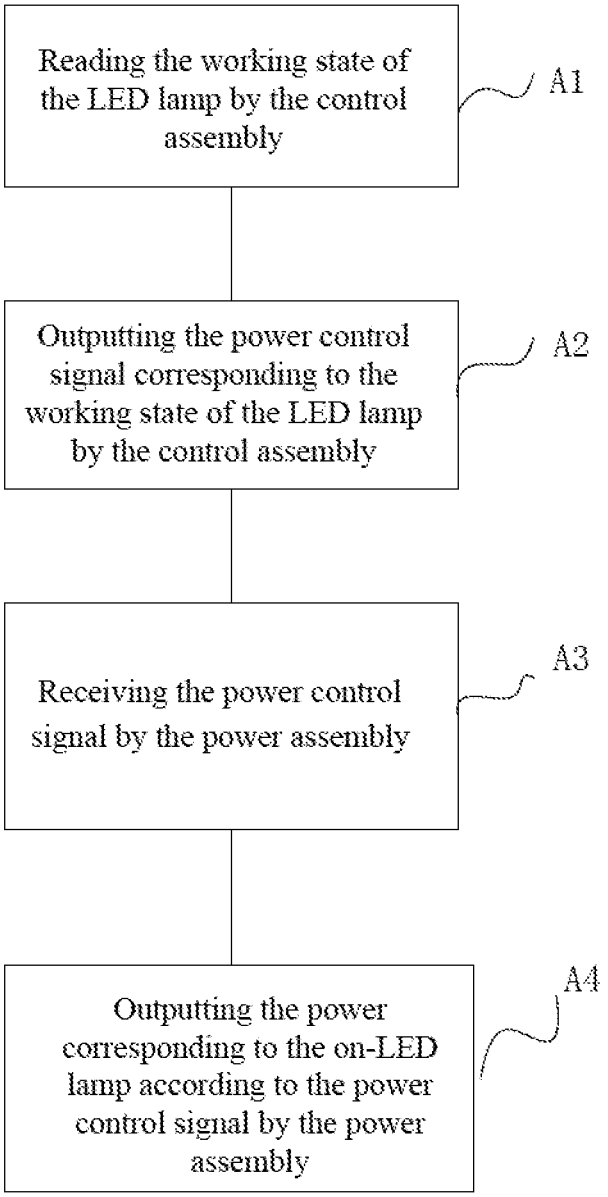
FIG. 3 is a simple flowchart of a method for driving a backlight driving circuit of the present disclosure.

FIG. 3 is a simple flowchart of a method for driving the backlight driving circuit of the present disclosure capable of reducing the power loss of the backlight driving, the method comprises following steps:

A1: reading the working state of the LED lamp by the control assembly;

A2: outputting the power control signal corresponding to the working state of the LED lamp by the control assembly;

A3: receiving the power control signal by the power assembly; and

A4: outputting the power corresponding to the on-LED lamp according to the power control signal by the power assembly.

The power control signal controlling the output power of the power assembly is obtained according to the working state of the LED lamp, which improves relativity between the LED lamp and the power assembly, thus, the power assembly adjusts the output frequency thereof according to the working state of the LED lamp, thereby reducing unwanted power output.

Figure 4:
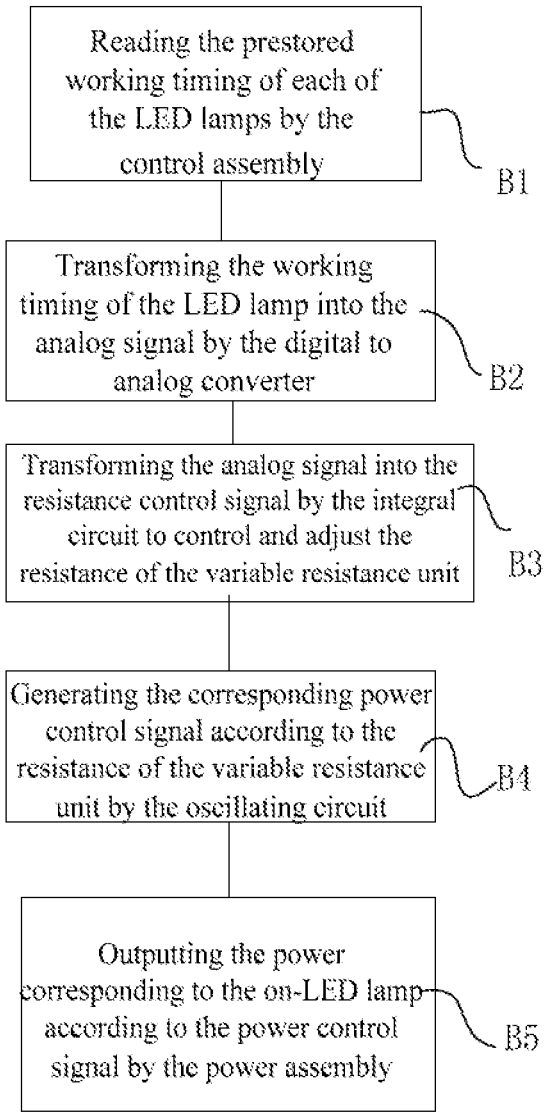
FIG. 4 is a detailed flowchart of a method for driving a backlight driving circuit of the present disclosure.

FIG. 4 is a detailed flowchart of a method for driving the backlight driving circuit of the present disclosure capable of reducing the power loss of the backlight driving, the method comprises:

B1: reading the prestored working timing of each of the LED lamps by the control assembly;

B2: transforming the working timing of the LED lamp into the analog signal by the digital to analog converter;

B3: controlling the variable resistance unit to adjust the resistance thereof through the analog signal processed by the integral circuit;

B4: generating a corresponding power control signal according to the resistance of the variable resistance unit by the oscillating circuit; and B5: controlling the boost unit to output the power corresponding to the on-LED lamp according to the power control signal by the power chip of the power assembly.

The working timing of the LED lamps is prestored, and is read when needed, which improves the response speed of the backlight driving circuit. The working state of the LED lamp is transformed into the feedback of the changed resistance of the variable resistance unit that can be received by the power assembly, which makes the working state of the LED lamp be actually feedback to the power assembly. Thus, the power assembly adjusts the output power thereof according to the working state of the LED lamp, and thereby improves work efficiency of the backlight driving.

Figure 5:
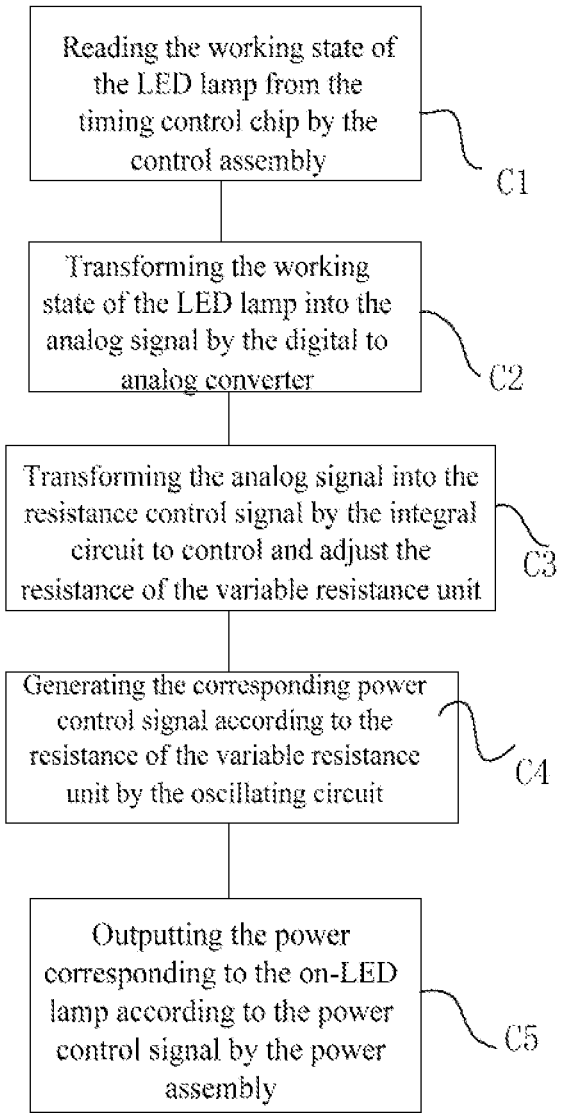
FIG. 5 is a circuit flowchart of a method for driving a backlight driving circuit of the present disclosure.

FIG. 5 is a circuit flowchart of a method for driving the backlight driving circuit of the present disclosure capable of reducing the power loss of the backlight driving, the method comprises:

C1: reading the working state of the LED lamp from the timing control chip by the control assembly;

C2: transforming the working state of the LED lamp into the analog signal by the digital to analog converter;

C3: controlling the variable resistance unit to adjust the resistance thereof through the analog signal processed by the integral circuit;

C4: generating a corresponding power control signal according to the resistance of the variable resistance unit by the oscillating circuit; and C5: controlling the boost unit to output the power corresponding to the on-LED lamp according to the power control signal through the power chip of the power assembly.

The timing control chip dynamically reads the working state of the LED lamp, transforms and sends a real-time working state of the LED lamp to the power chip, which makes the power chip output the power corresponding to the on-LED lamp. Thus, when the brightness of most or all LED lamps decreases, the power assembly reduces the output power and the power loss, and when the brightness of most or all LED lamps increases, the power assembly increases the output power, which avoids the lack of the brightness of the LED lamp because of the low power.

The present disclosure is described in detail in accordance with the above contents with the specific exemplary examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

I claim:

1. A light emitting diode (LED) backlight driving circuit, comprising:

a power assembly;

a control assembly; and at least two LED lamps;

wherein the control assembly generates a power control signal according to a working state of the LED lamp, and the power assembly outputs power corresponding to an on-LED lamp according to the power control signal, wherein the power assembly comprises a boost unit and a power chip, the power chip controls an output power of the boost unit; the control assembly comprises an oscillating circuit and a control unit, the control unit generates a resistance control signal according to the working state of the LED lamp, and the oscillating circuit generates the power control signal according to the resistance control signal and sends the power control signal to the power chip; the power chip controls the boost unit to output the power corresponding to the on-LED lamp according to the power control signal, wherein the oscillating circuit comprises a variable resistance unit, the variable resistance unit comprises a resistor and a controllable switch connected with each other in parallel; the power chip comprises a frequency control pin; the variable resistance unit adjusts a resistance according to the resistance control signal through the controllable switch; the oscillating circuit generates the power control signal according to a changed resistance of the variable resistance unit and sends the power control signal to the frequency control pin; and the power chip controls the boost unit to output the power corresponding to the on-LED lamp according to the power control signal.

2. The LED backlight driving circuit of claim 1, wherein the control unit further comprises an integral circuit and a control chip, the controllable switch is a semiconductor controllable switch; the control chip transforms the working state of the LED lamp into an analog signal, and the integral circuit processes the analog signal to generate a resistance control signal; and the resistance control signal is sent to a control end of the semiconductor controllable switch.

3. The LED backlight driving circuit of claim 2, wherein the control unit further comprises a memory chip storing the working timing of the LED lamps; the control chip obtains the working timing of the LED lamps from the memory chip, and transforms the working timing of the LED lamps into the analog signal; the integral circuit generates the resistance control signal according to the analog signal, and the resistance control signal controls the semiconductor controllable switch.

4. The LED backlight driving circuit of claim 2, wherein the control unit further comprises a timing control chip transforming the working state of the LED lamp into a display driving timing; the control chip obtains the display driving timing of the LED lamps from the timing control chip, and transforms the display driving timing of the LED lamps into the analog signal; the integral circuit generates the resistance control signal according to the analog signal, and the resistance control signal controls the semiconductor controllable switch.

5. A method for driving a light emitting diode (LED) backlight driving circuit, comprising:

reading a working state of an LED lamp using a control assembly;

outputting a power control signal corresponding to the working state of the LED lamp by the control assembly; and outputting power corresponding to an on-LED lamp according to the power control signal by a power assembly;

prestoring a working timing of each of the LED lamps by the control assembly;

transforming the working state of the LED lamp into an analog signal by a digital to analog converter, controlling a variable resistance unit to adjust a resistance by an integral circuit, and generating the power control signal corresponding to the working state of the LED lamp according to the resistance of the variable resistance unit by an oscillating circuit; and controlling a boost unit to output the power corresponding to the on-LED lamp according to the power control signal through the power chip of the power assembly.

6. The method for driving the LED backlight driving circuit of claim 5, wherein the step comprises:

reading the working state of the LED lamp from the timing control chip by the control assembly;

transforming the working timing of the LED lamp into an analog signal by a digital to analog converter, controlling a variable resistance unit to adjust a resistance by an integral circuit, and generating the power control signal corresponding to the working state of the LED lamp according to the resistance of the variable resistance unit by an oscillating circuit; and controlling a boost unit to output the power corresponding to the on-LED lamp according to the power control signal by the power chip of the power assembly.

* * * * *